US005084735A

United States Patent [19]

Rimai et al.

[11] Patent Number: 5,084,735

[45] Date of Patent: Jan. 28, 1992

[54] INTERMEDIATE TRANSFER METHOD AND ROLLER

[75] Inventors: Donald S. Rimai, Webster; Carlton Baxter; Mark C. Zaretsky; Larry H. Judkins, all of Rochester, all of N.Y.

[73] Assignee: Eastman Kodak Company, Rochester, N.Y.

[21] Appl. No.: 603,068

[22] Filed: Oct. 25, 1990

[51] Int. Cl.[5] ..... G03G 15/14

[52] U.S. Cl. ..... 355/271; 355/326

[58] Field of Search ..... 355/271, 272, 273, 274, 355/277, 326, 327, 210, 211; 430/106.6, 109, 126, 111

[56] References Cited

U.S. PATENT DOCUMENTS

| | | | |
|---|---|---|---|
| 3,697,171 | 10/1972 | Sullivan | 355/274 X |
| 3,811,765 | 5/1974 | Blake | 430/126 X |
| 3,893,761 | 7/1975 | Buchan et al. . | |
| 3,923,392 | 12/1975 | Buchan et al. . | |
| 4,068,937 | 1/1978 | Willemse et al. . | |
| 4,430,412 | 2/1984 | Miwa et al. . | |
| 4,453,820 | 6/1984 | Suzuki | 355/273 X |
| 4,455,079 | 6/1984 | Miwa et al. . | |
| 4,531,825 | 7/1985 | Miwa et al. | 355/271 X |
| 4,702,959 | 10/1987 | Shimozawa et al. | 427/128 X |
| 4,737,433 | 4/1988 | Rimai et al. . | |
| 4,869,982 | 9/1989 | Murphy | 430/126 X |
| 4,899,196 | 2/1990 | Mahoney | 355/271 |
| 4,984,026 | 1/1991 | Nishise et al. | 355/277 |
| 4,985,327 | 1/1991 | Sakashita et al. | 430/111 X |
| 5,027,158 | 6/1991 | Tomplins et al. | 355/327 X |

OTHER PUBLICATIONS

D. S. Rimai, L. P. DeMejo and R. C. Bowen, J. Appl. Phys. 66, pp. 3574-3578 (1989).

Desauer and Clark, Xerography and Related Processes, p. 393, Focal Press (NY).

N. S. Goel and P. R. Spencer, Polym. Sci. Technol. 9B, pp. 763-827 (1975).

*Primary Examiner*—A. T. Grimley

*Assistant Examiner*—Sandra L. Brasé

*Attorney, Agent, or Firm*—Leonard W. Treash, Jr.

[57] ABSTRACT

A small particle toner image is formed on a primary image member, such as a photoconductor, and electrostatically transferred to an intermediate image member and then electrostatically transferred to a receiving sheet. The intermediate image member is chosen to have characteristics making the toner less attractive to the primary image member, but more attractive to the receiving sheet, than the intermediate.

The intermediate transfer member can include a base of a relatively compliant material having a Young's modulus $10^7$ Newtons per square meter or less with a very thin outer skin of a harder material having a Young's modulus of $5\times10^7$ Newtons per square meter or more.

13 Claims, 1 Drawing Sheet

INTERMEDIATE TRANSFER METHOD AND ROLLER

FIELD OF THE INVENTION

This invention relates to the transfer of electrostatically formed toner images using an intermediate transfer member. It is particularly useful in creation of multicolor toner images with small particle toners.

BACKGROUND OF THE INVENTION

The use of toner transfer intermediates has been suggested for a number of reasons in electrophotography including simplified receiving sheet handling, doing single pass duplexing, saving wear on photoconductors and superposition of images, e.g., to form multi-color images. Typically, a toner image is created on a photoconductive member electrophotgraphically and is transferred by conventional, electrical field assisted transfer to an intermediate roller or web. For example, a negatively charged toner image is transferred from a photoconductor having a grounded backing electrode to an intermediate web or roller biased to a strong positive polarity. The toner image is then transferred from the intermediate member to a receiving sheet under the influence of a second electric field which can be created without changing the field on the intermediate member by placing a roller (or corona) behind the receiving sheet biased still stronger in a positive direction.

Although other reasons mentioned above for using intermediate transfer are still valid, it appears the most desirable use of it in the future may be for creating multi-color images. When an intermediate transfer member is used, two, three, or four separate images of different color can be transferred in registration to the intermediate to create a multi-color image and then the multi-color image can be transferred in one step to the receiving sheet. This system has a number of advantages over the more conventional approach to making multi-color images in which the receiving sheet is secured to the periphery of a roller and rotated repeatedly into transfer relation with the photoconductor to receive the color images directly. Probably the most important advantage is that the receiving sheet itself does not have to be attached to a roller. This has turned out to be a source of misregistration of images as well as complexity in apparatus. Other advantages associated with wear and tear on the photoconductive member and a straight and simple receiving sheet path are also important.

As color electrophotography improves, especially electrophotographic color printing, higher and higher resolutions are desired. In order to obtain higher resolution in color electrophotography, fine toners are necessary. Toners less than 20 microns, and especially toners less than 10 microns in size, give substantially improved resolution in color imaging with high quality equipment.

Unfortunately, fine toners are more difficult to transfer electrostatically than are traditional coarse toners. This is a problem in conventional electrophotography utilizing a single transfer with fine toner particles. It is considerably more of a problem using intermediate transfer members where two transfers are necessary.

Many transfer materials have been suggested for intermediate transfer systems. The most common are relatively soft materials, such as silicone rubber, polyurethane, or fluroelastomers; see, for example, U.S. Pat.

Nos. 3,893,761; 4,453,820; 3,923,392; 4,455,079; 4,453,820; 4,068,937; or 3,697,171.

U.S. Pat. No. 4,430,412 is typical of a number of patents in which the first transfer is made with or without the benefit of an electrical field by choice of materials and the second transfer to the receiving sheet is aided by heating the toner to its softening point which both aids the transfer and provides an at least partially fixed image on the receiving sheet. This patent suggests that certain silicone rubber materials are soft enough to "seize" the toner from the photoconductor, but still permit transfer with the aid of the heat at the second transfer. Although the materials suggested in this patent may work well in a system which utilizes heat at the second transfer, when used with dry materials in the absence of heat and utilizing electrostatics for both transfers, they are effective to receive the image from most photoconductive members, but are too soft to pass it well to the usual receiving sheet. The role of soft materials on adhesion is discussed in a paper by D. S. Rimai, L. P. DeMejo and R. C. Bowen, *J. Appl. Phys.* 66, 3574–3578 (1989). In brief, the soft substrate allows the particles to embed, thereby increasing the force of adhesion and making removal difficult.

When transferring toners having a mean particle size less than 20 microns and using electrostatics at both transfers, a number of transfer artifacts occur. For example, a well known artifact called "hollow character" causes insufficient transfer in the middle of high density toned areas, e.g., in alphanumerics. Another artifact, "halo" is experienced when toner fails to transfer next to a dense portion of an image. Use of the materials suggested in the prior art tends to give these artifacts and others when using two electrostatic transfer steps. These problems cannot be eliminated merely by increase of the transfer field, since that expedient is limited by electrical breakdown.

Studies have been done of the forces causing adherence of toner to photoconductive and other surfaces as toner particles become smaller. These studies indicate that forces such as van der Waals forces holding toner to the surface of a photoconductive element have greater holding effect compared to electrostatic image forces as toner particles become smaller. For example, it is believed that, as toner particle size is reduced to 10 microns, the electrostatic force of the electrostatic image may be less than 10% of the total forces holding toner to the surface. See Rimai and Chowdry, U.S. Pat. No. 4,737,433. See, also, Dessauer and Clark, *Xerography And Related Processes*, page 393, Focal Press (NY), N. S. Goel and P. R. Spencer, *Polym. Sci. Technol.* 9B, pp 763–827 (1975).

SUMMARY OF THE INVENTION

We have found that careful choice of materials with respect to these non-image forces affecting toner particles can greatly improve the final transferred image.

It is the object of the invention to provide a method of transferring toner images electrostatically from a first image member to an intermediate image member and then electrostatically from the intermediate image member to a receiving sheet with a minimum of image defects and a maximum of utilized toner transferred.

It is also an object of the invention to provide an intermediate transfer roller usable in the above method.

The above and other objects are accomplished by a method of forming a toner image on a receiving sheet in which an electrostatic image is first formed on a primary image member, the electrostatic image is toned with a dry toner to form a toner image and the toner image is transferred from the primary image member to an intermediate image member in the presence of an electric field urging toner particles from the primary image member to the intermediate image member. The toner image is then transferred from the intermediate image member to a receiving sheet in the presence of an electric field urging the toner particles from the intermediate image member to the receiving sheet. The method is characterized by a careful choice of materials for the image member and the intermediate image member. That is, the release characteristics of both the primary image member and the intermediate image member and the proposed receiving sheet with respect to the toner particles are such that the toner more readily adheres to the intermediate image member than the primary image member and more readily adheres to the receiving sheet than the intermediate image member (ignoring the effect of the transfer field).

The intermediate member must be picked to have good release characteristics when transferring toner to the receiving sheet, but not so good that it is unable to effect thorough and complete transfer from the primary image member. This window can be widened by increasing the release characteristics of the primary image member, e.g., by utilizing a photoconductor having a fluorinated hydrocarbon as part of its outer surface or by applying zinc stearate or another similar release material to the image carrying surface of the primary image member. With such materials, an intermediate image member can be used with release characteristics that are good compared to the final receiving sheet, thereby obtaining effective transfer in both transfers.

Thus, according to a preferred embodiment, the intermediate should be relatively hard material, e.g., having a Young's modulus in excess of $5\times10^7$ Newtons per square meter. The hardness of the material is important in effecting release to the receiving sheet at the second transfer.

When the process is used for superposition of color images, registration is easier maintained when the intermediate is a roller or drum. Effective electrostatic transfer at both the transfer to the intermediate and away from the intermediate is best effected with a nip of some width which can be effected by some compliance in the transfer roller. The roller also has to participate in establishment of both transfer fields. Accoring to a preferred embodiment, we have found that the combined requirements of such a transfer roller are best met with a transfer roller of multi-layer design. It should have a core or base of a material having the appropriate conductivity necessary for creation of an electric field and appropriate compliance for formation of transfer nips, both of which characteristics are well known attributes of appropriately treated polyurethane. Preferably the core or base has a Young's modulus of $10^7$ Newtons per square meter or less. Around the core is placed or coated an extremely thin skin of another material which cooperates with the primary image member surface, the receiver surface and the toner to satisfy the release characteristics of this invention. Preferably, the thin skin has a Young's modulus of $5\times10^7$ Newtons per square meter or more.

DETAILED DESCRIPTION OF THE PREFERRED EMBODIMENT

Figure 1:
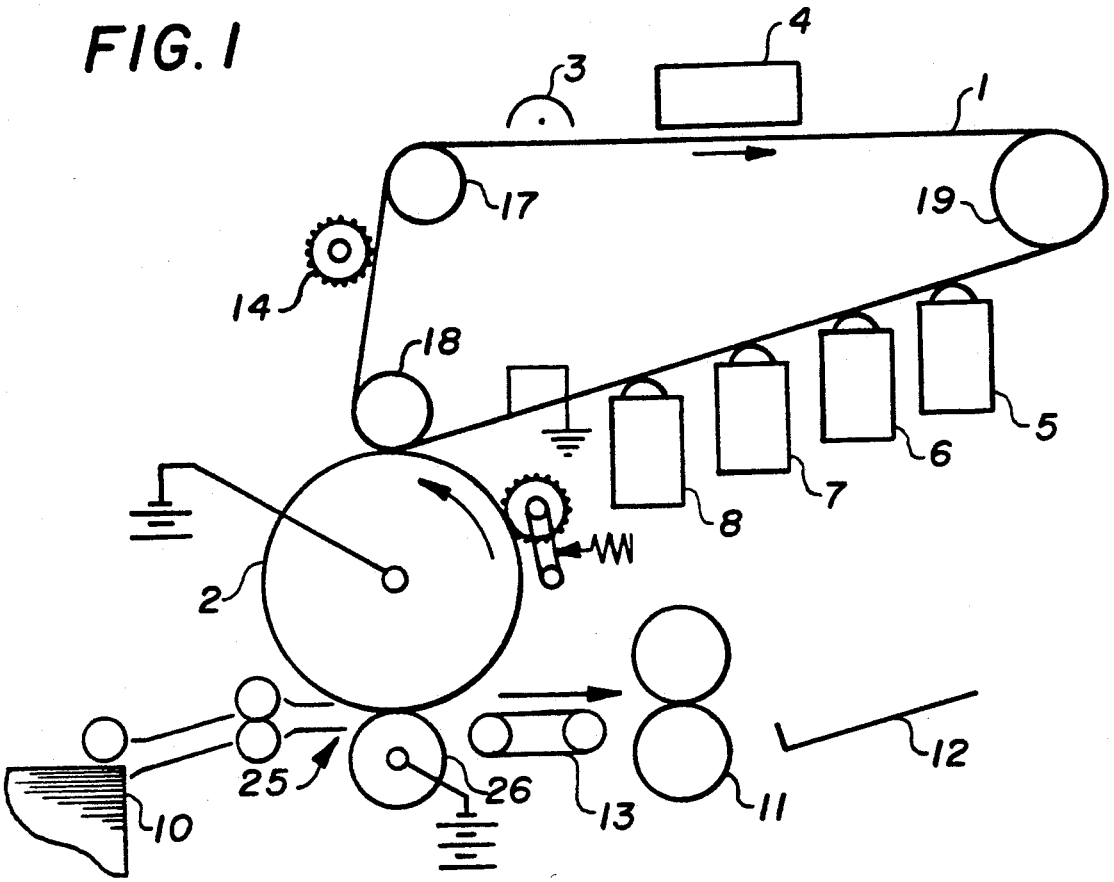
FIG. 1 is a side schematic of a color printer apparatus utilizing the invention.

FIG. 1 illustrates an apparatus in which the invention is intended to be used. A primary image member, for example, a photoconductive web 1 is trained about rollers 17, 18, and 19, one of which is drivable to move image member 1 past a series of stations well known in the electrophotographic art. Primary image member 1 is uniformly charged at a charging station 3, image-wise exposed at an exposure station 4, e.g., an LED print head or laser electronic exposure station, to create an electrostatic image. The image is toned by one of toner stations 5, 6, 7, or 8 to create a toner image corresponding to the color of toner in the station used. The toner image is transferred from primary image member 1 to an intermediate image member, for example, intermediate transfer roller or drum 2 at a transfer station formed between roller 18, primary image member 1, and transfer drum 2. The primary image member 1 is cleaned at a cleaning station 14 and reused to form more toner images of different color utilizing toner stations 5, 6, 7, and 8. One or more additional images are transferred in registration with the first image transferred to drum 2 to create a multi-color toner image on the surface of transfer drum 2.

The multi-color image is transferred to a receiving sheet which has been fed from supply 10 into transfer relationship with transfer drum 2 at transfer station 25. The receiving sheet is transported from transfer station 25 by a transport mechanism 13 to a fuser 11 where the toner image is fixed by conventional means. The receiving sheet is then conveyed from the fuser 11 to an output tray 12.

The toner image is transferred from the primary image member 1 to the intermediate transfer drum 2 in response to an electric field applied between the core of drum 2 and a conductive electrode forming a part of primary image member 1. The multi-color toner image is transferred to the receiving sheet at transfer station 25 in response to an electric field created between a backing roller 26 and the transfer drum 2. Thus, transfer drum 2 helps establish both electric fields. As is known in the art, a polyurethane roller containing an appropriate amount of anti-static material to make it of at least intermediate conductivity can be used for establishing both fields. Typically, the polyurethane is a relatively thick layer, e.g., one-quarter inch thick, which has been formed on an aluminum base. Typically, the electrode buried in primary image member 1 is grounded for convenience in cooperating with the other stations in forming the electrostatic and toner images. If the toner is a positively-charged toner, an electrical bias applied to intermediate transfer drum 2 of typically −1,000 to −1,500 volts will effect substantial transfer of toner images to transfer drum 2. To then transfer the toner image onto a receiving sheet at transfer station 25, a bias, e.g., of −2,000 volts, is applied to backing roller 26 to again urge the positively charged toner to transfer to the receiving sheet. Schemes are also known in the art for changing the bias on drum 2 between the two transfer locations so that roller 26 need not be at such a high potential.

Unfortunately, with small toners, utilizing a polyurethane roller and transferring the toners directly to the polyurethane surface, and then to the receiving sheet, transfer artifacts are observed on the receiving sheet. This is due to insufficient transfer under the urging of the electrostatic fields at one of the two transfer stations. We believe these artifacts to be due to the electrostatic field in a given area to be unable to overcome non-electrostatic forces between the toner and the surfaces involved. Increasing the electric field risks electrical breakdown.

We have found that if the intermediate member has a surface of material having release characteristics that are such that the toner prefers or adheres more readily to such surface than to that primary image member 1 and less readily to the surface than the receiving sheet, image artifacts of the nature described are greatly reduced.

Figure 2:
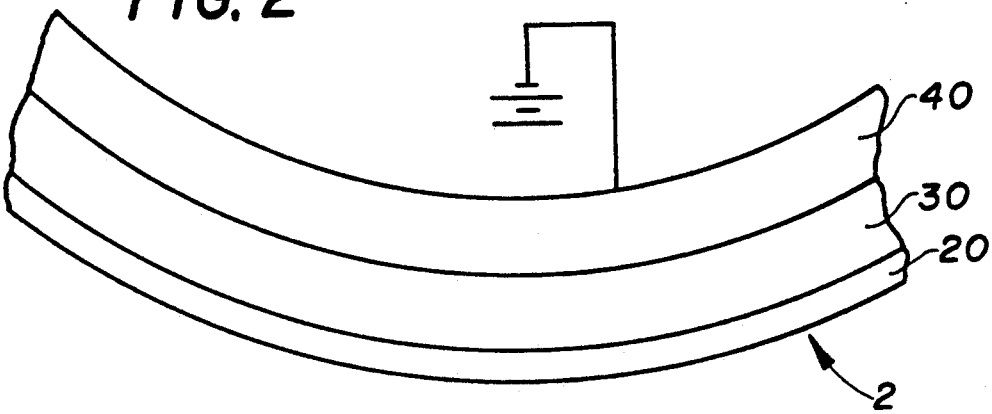
FIG. 2 is a cross-section of a portion of an intermediate transfer roller or drum constructed according to the invention.

A partial cross-section of a preferred embodiment of such an intermediate member is shown in FIG. 2 in which a roller or drum 2 having a polyurethane base 30 has a thin skin 20 coated or otherwise formed on it having the desired release characteristics. The polyurethane base has an aluminum core 40.

Since the invention is dependent upon relative release characteristics with respect to toner, four parameters may be worked with, that is, the characteristics of the toner and the respective characteristics of the surfaces of the image member, the intermediate member, and the receiving sheet. In some special applications, a particular receiving sheet could be specified. However, for most applications it is plain paper which has a fairly strong attraction for most toners. As the paper gets more finely finished, or transparency stock is substituted, it may have better release properties and may increase the problems of choosing the material for the intermediate and for the primary image member. The toner may also be varied somewhat. However, it has certain requirements for both development and fusing that greatly restrict its formulation and in most instances that formulation will not be conveniently variable when designing the transfer materials. Thus, the two parameters left are the release characteristics of the primary image member and the release characteristics of the intermediate image member.

Adding a fluoropolymer or a silicone to the formulation of the surface layer in primary image member 1 or applying a substance such as zinc stearate to the surface of image member 1 is a known expedient in conventional electrophotography and increases release characteristics of the primary image member as to all toners. When applied to this invention, it widens the window available when picking material for the intermediate image member.

We have also found that the surface of the intermediate member should be relatively hard, preferably having a Young's modulus in excess of $5\times10^7$ Newtons per square meter, to facilitate release of the toner to ordinary paper or another type receiving sheet. As will be seen from the examples, the intermediate preferably has a base or core having a Young's modulus $10^7$ Newtons per square meter or less to assure good compliance for each transfer.

EXAMPLE 1

A primary image member, having an aggregated organic photoconductor as a charge transport layer was treated with a fluoronated polymer, Fluo-HT (a trademark of Micropowders, Inc.) to enhance its release characteristics and a series of different color images were formed on it using cross-linked polyester toners having a mean particle size less than 15 microns. The images were transferred to an intermediate consisting of a similar material which had been coated with zinc stearate to increase its release characteristics and the image was then transferred to paper. The intermediate was wrapped around a polyurethane roller having a Young's modulus of approximately $5\times10^6$ Newtons per square meter and a resistivity of $10^{10}$ ohm-cm. The Young's modulus of the primary image member was approximately $10^9$ Newtons per square meter. In each instance the transfers were carried out in the presence of a potential of approximately 1,000 volts urging the transfer. Sever hollow characters were observed in the final print. Examination of the primary image member and the intermediate showed that the hollow characters occurred due to a failure to transfer from the primary image member to the intermediate, illustrating the problem of having an intermediate with release characteristics (due to the zinc stearate) superior to that of the primary image member with respect to the toner. These defects occur despite the force of the electrostatic field.

EXAMPLE 2

In Example 2 the same photoconductor treated with Fluo-HT was used, but the intermediate included an outer layer of Kapton-H (a trademark of DuPont applied to high surface energy polyamides). Kapton-H has good release characteristics, a Young's modulus in excess of $10^9$ Newtons per square meter, but its release characteristics are not as good as that of the Fluo-HT treated photoconductor. Reasonably good transfer was observed in the final print onto plain paper with no hollow characters indicating that both transfers were effective.

EXAMPLE 3

In this example, Kapton-F (also a trademark of DuPont) was used as an intermediate with the image member of Example 1. This material is a polyamide similar to Kapton-H except that it has greater release characteristics because of the presence of flurocarbons. Because of the release characteristics of the intermediate member, toner transfer from the photoconductor resulted in severe hollow character in the final image transferred to the receiving sheet.

EXAMPLE 4

In this example Kapton-H was used as the intermediate, but the aggregated organic photoconductor is treated with zinc stearate. The zinc stearate treated photoconductor has superior release characteristics to even the Fluo-HT treated photoconductor and the final image after two transfers was good without hollow characters. Transfer was slightly better than Example 2.

EXAMPLE 5

The zinc stearate treated photoconductor from the previous example was used with Kapton-F as an intermediate. Because of the release characteristics of the photoconductor treated with zinc stearate, transfer was substantially improved over Example 3 where Kapton-F was used with a Fluo-HT treated photoconductor, but transfer was not quite as good as Examples 2 and 4.

EXAMPLE 6

The original photoconductor from Example 1 was used with an intermediate of Kapton-H, in this instance, the Kapton-H was in the form of a blanket 2 mils thick wrapped around a polyurethane roller. Transfer was reasonably good with hollow character absent, but a bit of halo defect was observed.

EXAMPLE 7

The same materials were used as in Example 6 except that 1 mil Kapton-H was used as the skin of the intermediate instead of 2 mil Kapton-H. In this instance halo was greatly reduced.

EXAMPLE 8

This example is the same as Example 6 except that 0.5 mil Kapton-H was used. Halo was virtually eliminated.

The improvement as a result of the thinness of the skin of the Kapton-H is an interesting result of the examples. The polyurethane base has a Young's modulus of about $10^6$ Newtons per square meter. We believe that this result is due to the compliance of the polyurethane being more effective in providing good contact with the primary image member through the thin Kapton-H skin, while the skin provides good release characteristics for transfer to the paper receiver.

EXAMPLE 9

A 0.2 inch polyurethane base on an aluminum core was coated with an overcoat of a siloxane/urethane block copolymer having approximately 10% siloxane by weight to produce an intermediate image member. The overcoat was approximately 2 microns thick and had a volume resistivity of $10^{12}$ ohm-cm and a Young's modulus of approximately $10^8$ Newtons per square meter. The polyurethane base had sufficient anti-static material to have a volume resistivity of $10^{10}$ ohm-cm. It had a Young's modulus of $10^6$ Newtons per square meter.

Using a primary image member similar to Example 1, polyester toners having a mean volume diameter of 12 microns and 7 microns were effectively transferred to 20 pound bond paper, Vintage Velvet Offset paper and transparency stock.

EXAMPLE 10

This example is the same as Example 9 except that the intermediate overcoat was a 5 micron coating of a hard urethane resin sold under the tradename Permuthane by Permuthane, Inc., a division of ICI Inc., and having a Young's modulus of $10^8$ Newtons per square meter and a volume resistivity of approximately $10^{12}$ ohm-cm.

Again, effective transfers were achieved with the same materials as in Example 9.

EXAMPLE 11

This example is the same as Examples 9 and 10 except that the intermediate image member overcoat was a 5 micron overcoat of a high molecular weight polycarbonate having a Young's modulus of $10^8$–$10^9$ Newtons per square meter and a volume resistivity of $10^{12}$ ohm-cm. Effective transfer was again achieved with the materials of Examples 9 and 10.

Thus, in a preferred embodiment, the intermediate image member is a drum, roller or other endless member having a base material, for example, polyurethane, having enough anti-static material added to have at least overall intermediate conductivity, with a Young's modulus $10^7$ Newtons per square meter or less and a thin skin of harder material, having a Young's modulus greater than $5\times10^7$ Newtons per square meter and preferably in excess of $10^8$ Newtons per square meter. The thin skin should be one mil or less in thickness, preferably, less than 10 microns. Preferably, the skin should be also of intermediate conductivity, although if it is very thin, it can be less conductive than the base.

The excellent results with 7 micron toner was especially remarkable considering the usual difficulties in electrostatically transferring such fine toners.

The invention has been described in detail with particular reference to a preferred embodiment thereof, but it will be understood that variations and modifications can be effected within the spirit and scope of the invention as described hereinabove and as defined in the appended claims.

We claim:

1. A method of forming a toner image on a receiving sheet, which method comprises:

forming an electrostatic image on a primary image member, toning said image with a dry toner to form a toner image, transferring said toner image from said primary image member to an intermediate image member in the presence of an electric field uring toner particles from said primary image member to said intermediate image member, and transferring said toner image from said intermediate image member to a receiving sheet at a temperature below the glass transition temperature of said toner in the presence of an electric field urging toner particles from said intermediate image member to said receiving sheet, characterized in that the step of toning the image is carried out by applying a dry toner to said electrostatic image having a mean particle size less than 15 microns and the surfaces of the primary image member, the intermediate image member and the receiving sheet that carry toner images have release characteristics with respect to the toner particles of said images such that the toner more readily adheres to the intermediate image member than the primary image member and more readily adheres to the receiving sheet than the intermediate image member and the intermediate image member has a Young's modulus in excess of $5\times10^7$ Newtons per square meter.

2. The method according to claim 1 wherein the image carrying surface of the primary image member has been treated with a release agent to enhance its release characteristics.

3. The method according to claim 1 wherein the image carrying surface of the primary image member has been treated with zinc stearate or a fluorocarbon to enhance its release characteristics.

4. The method according to claim 1 wherein said transferring steps are accomplished with an intermediate image member which has a relatively compliant base, and a thin, hard outer skin defining the outside surface of said intermediate which surface has release characteristics making it more attractive to said toner than the primary image member and less attractive than the receiving sheet.

5. The method according to claim 4 wherein the compliant base has a Young's modulus of $10^7$ Newtons per square meter or less and the outer skin is one mil or less in thickness and has a Young's modulus of $5\times10^7$ Newtons per square meter or more.

6. The method according to claim 5 wherein said outer skin is less than 10 microns in thickness.

7. The method according to claim 5 wherein said intermediate is a roller having a polyurethane base.

8. An intermediate image member usable in the method of claim 1 comprising a roller having a base of compliant, at least intermediate conductivity material having a Young's modulus of $10^7$ Newtons per square meter or less, and a thin outer skin having a Young's modulus of $5\times10^7$ Newtons per square meter or more.

9. A member according to claim 8 wherein the thickness of said outer skin is one mil or less.

10. The member according to claim 8 wherein the thickness of said outer skin is 10 microns or less.

11. The member according to claim 8 wherein the base is polyurethane.

12. A method of forming a multicolor toner image on a receiving sheet, which method comprises:

forming a series of electrostatic images on a primary image member, toning said images with different color dry toners to form a series of different color toner images, transferring said different color toner images from said primary image member to an intermediate image member, in the presence of an electric field urging toner particles from said primary image member to said intermediate image member, in registration, to form a multicolor image on the intermediate member, and transferring said multicolor toner image from said intermediate image member to a receiving sheet, in the presence of an electric field urging toner particles from said intermediate image member to said receiving sheet, characterized in that said toning step is carried out with dry toner particles having a mean particle size less than 15 microns and the surfaces of the primary image member, the intermediate image member and the receiving sheet that carry toner images have release characteristics with respect to the toner particles of said images such that the toner more readily adheres to the intermediate image member than the primary image member and more readily adheres to the receiving sheet than the intermediate image member and the intermediate image member has a Young's modulus of $5\times10^7$ Newtons per square meter or more.

13. The method according to claim 12 wherein the intermediate image member is a roller having a polyurethane base and an outer skin defining the outside surface of said intermediate which outer skin is less than 10 microns thick.

* * * * *